United States Patent [19]

Fischer

[11] Patent Number: 4,595,201

[45] Date of Patent: Jun. 17, 1986

[54] TENSIONABLE RACKET HAVING UNIQUE STRINGING PATTERN

[76] Inventor: Herwig Fischer, Kickenstrasse 88, D-4156 Willich 4, Fed. Rep. of Germany

[21] Appl. No.: 561,595

[22] PCT Filed: Mar. 29, 1983

[86] PCT No.: PCT/EP83/00093

§ 371 Date: Nov. 30, 1983

§ 102(e) Date: Nov. 30, 1983

[87] PCT Pub. No.: WO83/03358

PCT Pub. Date: Oct. 13, 1983

[30] Foreign Application Priority Data

Mar. 30, 1982 [DE] Fed. Rep. of Germany ..... 3211738
Jul. 27, 1982 [DE] Fed. Rep. of Germany ... 8221340[U]

[51] Int. Cl.[4] ..... A63B 51/12
[52] U.S. Cl. ..... 273/73 E; 273/73 D
[58] Field of Search ..... 273/73 D, 73 E, 73 C, 273/73 J, 73 H, 73 R, 73 L, 67 R

[56] References Cited

U.S. PATENT DOCUMENTS

| | | | |
|---|---|---|---|
| 1,252,576 | 1/1918 | Hutchinson | 273/73 E |
| 1,470,878 | 10/1923 | Robinson | 273/73 D |
| 1,559,986 | 11/1925 | Quick | 273/73 E |
| 2,165,701 | 7/1939 | Goerke | 273/73 E |
| 2,206,548 | 7/1940 | Goerke | 273/73 E |
| 4,005,863 | 2/1977 | Henry | 273/73 D |
| 4,057,249 | 11/1977 | Reedhead et al. | 273/73 E |
| 4,118,029 | 10/1978 | Septier | 273/73 D |
| 4,183,200 | 1/1980 | Bajaj | 273/73 D |
| 4,203,597 | 5/1980 | Reedhead et al. | 273/73 E |
| 4,231,575 | 11/1980 | Kutt | 273/73 D |
| 4,273,331 | 6/1981 | Fischer | 273/73 D |

FOREIGN PATENT DOCUMENTS

| | | | |
|---|---|---|---|
| A351977 | 8/1979 | Austria . | |
| C808543 | 7/1951 | Fed. Rep. of Germany . | |
| A395669 | 10/1908 | France . | |
| 784057 | 7/1935 | France | 273/73 E |
| 2300584 | 9/1976 | France . | |
| 2373301 | 7/1978 | France . | |
| A22409 | 8/1930 | Netherlands . | |
| A4305 | of 1914 | United Kingdom . | |
| 262638 | 12/1926 | United Kingdom | 273/73 D |
| 359227 | 10/1931 | United Kingdom | 273/73 E |
| 380915 | 9/1932 | United Kingdom | 273/73 E |
| 566130 | 12/1944 | United Kingdom | 273/73 D |
| 2029241 | 3/1980 | United Kingdom . | |

*Primary Examiner*—Richard C. Pinkham
*Assistant Examiner*—Matthew L. Schneider
*Attorney, Agent, or Firm*—Cushman, Darby & Cushman

[57] ABSTRACT

The lengths of string (22 and 24) of a racket, more specially a tennis or squash racket, are trained over bend points of the frame (12) with a low degree of friction and are so strung backwards and forwards across the frame that the spacing between two parallel strings of the same length of string (22) is at least equal to the radius of a ball. Between these strings (**22*c* and 22*d*) there are parallel strings (24*d*), that are parts of other string lengths (24**). This system of stringing the frame makes it posible for tension forces produced on ball impact to be transmitted to other parts of the array of strings not contacting the ball.

11 Claims, 13 Drawing Figures

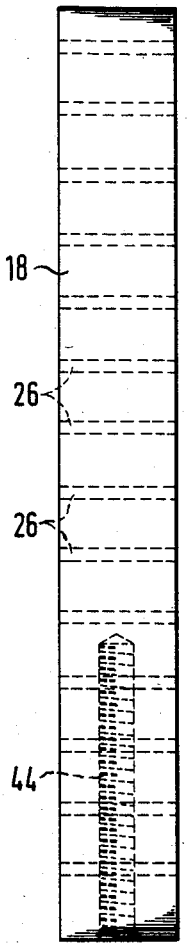
FIG. 3
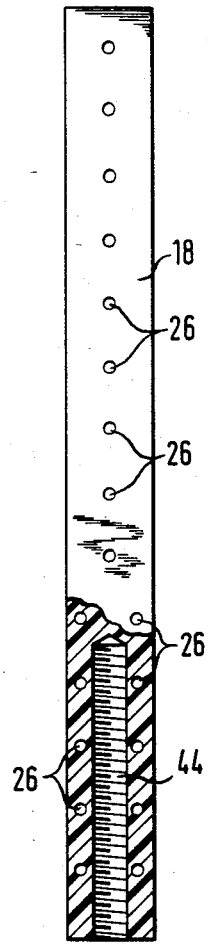
FIG. 4
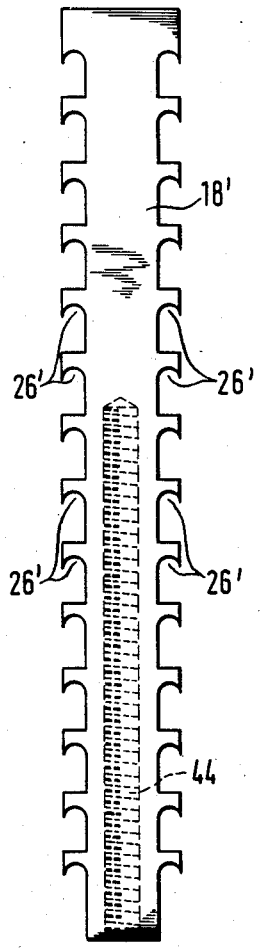
FIG. 5
FIG. 6
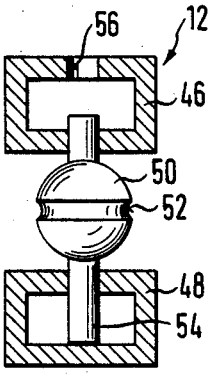
FIG. 7
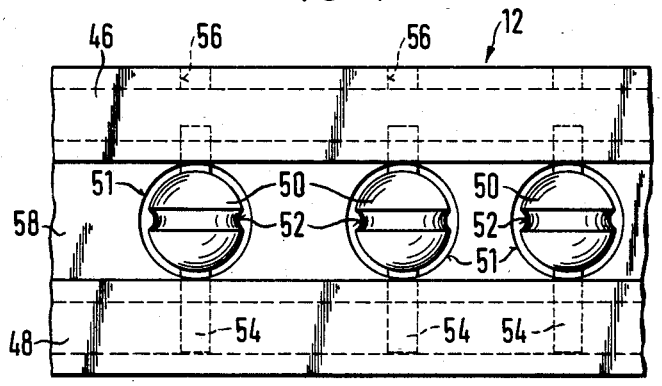

TENSIONABLE RACKET HAVING UNIQUE STRINGING PATTERN

BACKGROUND OF THE INVENTION

The present invention is with respect to a racket, such as racket for tennis or squash, having a generally elliptical frame, a handle fixed thereto and at least one string length strung across the frame in the form of crossing strings that are generally parallel to each other and are trained round at points on the frame with a low degree of friction.

THE PRIOR ART

In the case of well-known forms of tennis racket the lengths of string are stretched across the frame with an even or differential tension and fixed at their ends in the frame. Because the playing properties of a racket are dependent on a great number of different factors, that in some cases have opposite effects, such a stringing system will only, at the most, have good tension and impact loss properties at the so-called "sweet spot", that is to say the best point on the racket for hitting the ball. If the racket is so strung as to have the optimum properties at the sweet spot it is generally not possible for other parts of the strings to be given optimum properties. This being the case, the player will have a generally poor control of balls which are not hit at the sweet spot and this will put a strain on the wrist.

In an earlier design, see the British Pat. No. 380,915, the strings of a racket were to be trained over pulleys in the frame, which was to have a number of tensioning means for separately tensioning the strings. While this design did make minor trimming of the tension properties of the strings possible to a limited degree, there was still trouble with certain factors, such as stretching of the strings and placing them in the desired position, making it hard to get an optimum distribution of tension.

The French Pat. No. 784,057 has an account of a tennis racket strung with a single length of string that was trained over pulleys and joined with a tensioning means placed where the handle and frame are joined together (this part being named the "heart" of the racket) so that the player himself was to be able to make a change in the overall tension of the strings. Quite in addition to the fact that this did not make it possible for the tension of separate strings and the tension gradient to be changed in the racket, the performance of the racket was poor inasfar the effect of the large amount of friction at the crossing points of the strings was that it took some time before the tension produced by adjustment of the tensioning means became distributed over all the strings by a sort of slow slipping process.

Designs like this using guide pulleys in the frame and a tensioning means in the handle are furthermore to be seen in the British Pat. No. 2,029,241 and the U.S. Pat. No. 4,057,249, that as well are open to the same objections noted.

OVERVIEW OF THE INVENTION

The purpose of the invention is that of making for better elastic properties of the strings, more specially in respect of off-center ball contact.

This purpose is effected in the present invention inasfar as in at least part of the system of strings, parallel strings placed next to each other are parts of different lengths of string and the distance between strings forming part of one and the same length of string is at least equal to a ball radius.

In the case of such a stringing system the stretching of the strings directly impacted on contact with the ball is responsible for an increased tension of those parts of the same length of string that are at the edges of the ball contact spot or zone. This gives a distribution of tension, that is marked by a high elasticity in the ball contact spot, whereas the string array in a part forming a ring round this spot is more strongly tensioned and less pushed out of place so that there is a better control of the ball on hitting it. While on the one hand with a normal racket the position of the sweet spot is fixed once and for all, with a racket in keeping with the present invention one may say that, in a certain sense, the sweet spot will always be at the position of ball contact.

In a preferred form of the invention the strings are at least partly made longer past the limit of the frame area and such further string tails are guided so as to be freely stretchable and are joined with the strings within the frame at low friction guide points. The tails of the strings produced by making them longer past the edge of the frame are preferably taken up within the hollow handle and go as far as its end if desired.

This design makes it possible for the stretching or "live" length of separate strings or of all the strings, that is by the nature of thinge important for the elastic properties, to be made longer as may be desired.

The useful effect of this lengthening of the strings will be more specially clearly seen in the case of the short strings running along near edges of the frame, whose tension properties are always poor with known rackets. However this is not the only good effect, and there will be the same sort of useful property all over the strung area.

Preferably the tails of the strings are fixed within the handle of the racket at different positions on a long rider or slide that is able to be moved along inside the handle using a tensioning means, this tensioning means offering the user of the racket the chance of increasing or decreasing the overall tension of the strings to be at an optimum for the racket with respect to the tension distribution. In this respect it is certainly possible and in some cases even desired for the tensioning operation to make for different degrees of effect in a way in keeping with the different lengths of the strings.

In known rackets the frame has been mostly so designed that it is able to take up losses in impact or impetus within certain limits. The take-up or dissipation of such losses in impact, that are more specially likely when the ball is off center, may be made possible in the present invention by making the rider itself elastic in nature or having damping, elastically acting means for keeping it in position.

In keeping with a further preferred example of the invention the bend or change in direction between a string within the frame and the string tails running out past the frame is such that there is a low degree of friction with respect to a pulling force acting towards the inside of the frame, that is to say with respect to a springing effect of the string when hitting the ball, but on the other hand the string is braked on being pulled in the opposite direction. This makes possible a high degree of dissipation of impact loss, inasfar as the ball is softly and givingly taken up by the racket but is not at once thrown back by the string springing back immediately.

LIST OF VIEWS OF THE FIGURES

FIG. 3 is a view of one possible form of rider.

FIG. 4 is a partly cut away side view of the structure of FIG. 3 as seen from the left.

FIG. 5 is a view of a further example of the rider.

FIGS. 6 and 7 make clear how the pulleys are supported in the frame.

FIGS. 8 to 11 are views of further forms of the points at which the strings are trained over points on the frame.

Figure 12:
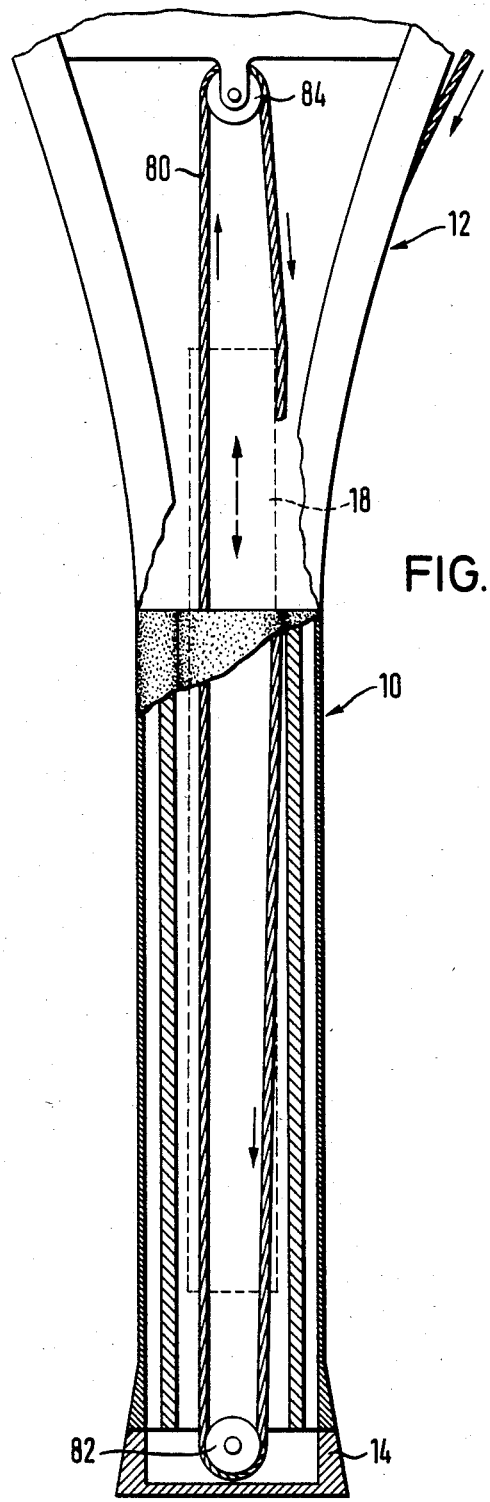

FIG. 12 is a partly cut open view of the handle of a further form of a tennis racket.

Figure 13:
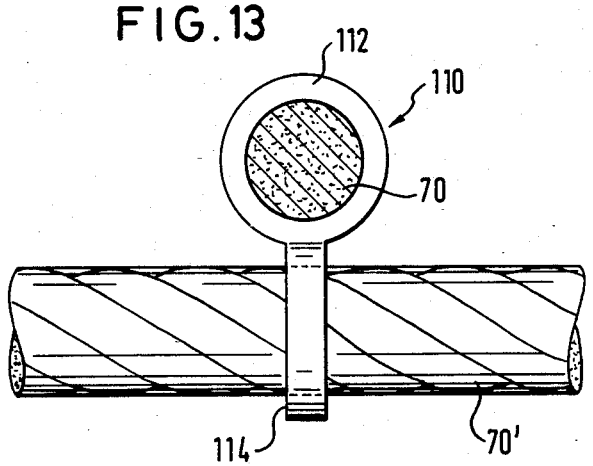

FIG. 13 is a view of a cross-over point of two strings in the racket of the invention.

ACCOUNT OF PREFERRED WORKING EXAMPLES OF THE INVENTION

Figure 1:
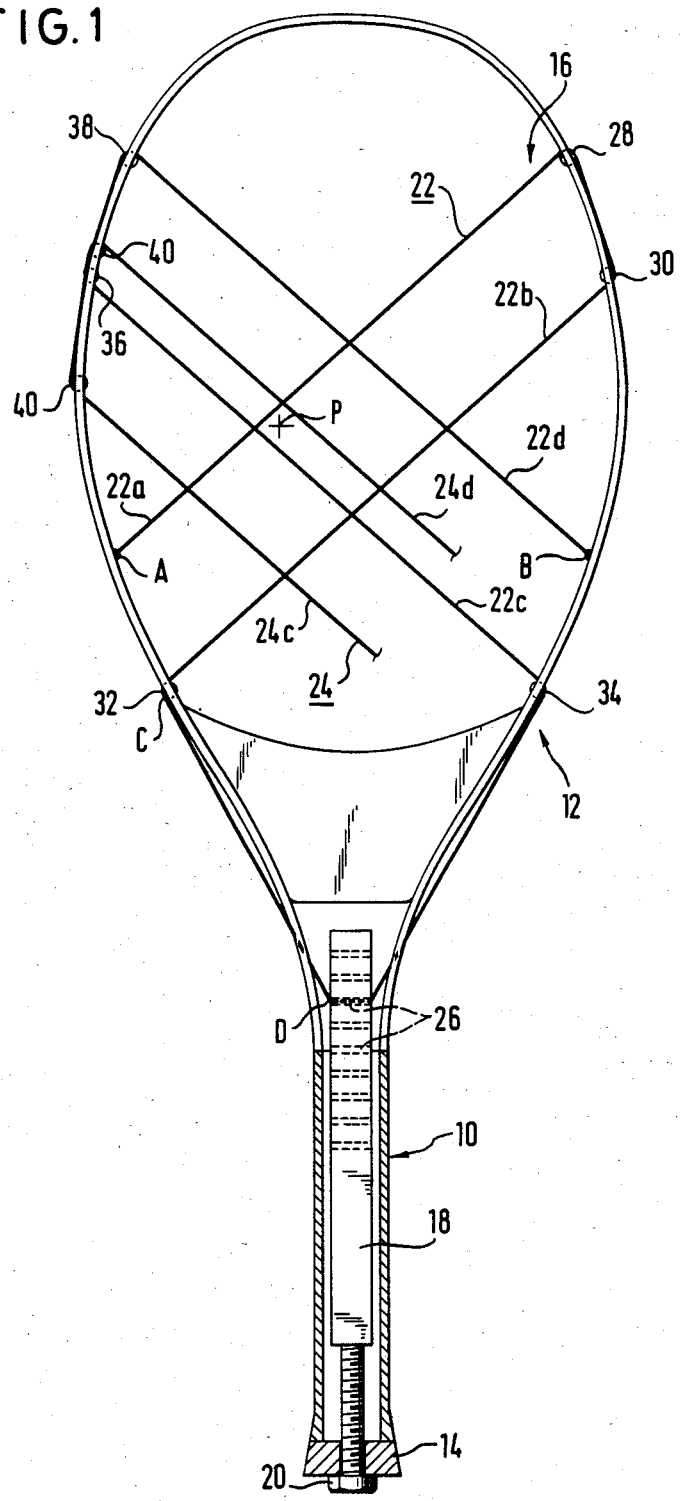
FIG. 1 is a diagrammatic and partly cut away plan view of one possible form of a tennis racket in keeping with the invention.

A tennis racket to be seen in FIG. 1 has a handle 10 and a frame 12. The handle is hollow in structure and at its free end has an end plate 14. Within the area of the frame 12 there is an array 16 of strings, that in FIG. 1 is only marked by a single string length 22 made up of separate strings, and a further string length 24 that is not completely marked in the figure. Within the hollow handle 10 there is a rider or slide 18 that may be moved along in the length direction. A tightening screw 20 is taken up in the plate 14 at the end of the handle and may be freely turned. The screw 20 is taken up in the lower end of the rider 18 threadedly so that by turning the tightening screw 20 the rider 18 may be moved along within the handle 10. The separate strings of the string array 16 are threaded into holes 26 in the rider 18 and for this reason may be tensioned together and in common by the player with the help of the tightening screw 20 for adjustment.

In the working example figured the racket is strung diagonally. The length of string 22 is fixed at point A on the lower left in FIG. 1 on the frame and strung as a first string 22*a* diagonally across the frame or frame area to a bend or guide pulley 28, the length of string 22 then running outside the frame to a further guide pulley 30, it then stretching as a further string 22*b* (part of the length 22, that is) parallel to the string 22*a* to a further bend pulley 32 (at point C). From the bend pulley 32 the length of string 22 is then trained through one of the holes 26 in the rider 18 within the hollow handle 10 (at point D) and then to a further bend pulley 34. Two further parallel strings 22*c* and 22*d* of the length of string 22 are trained symmetrically to the strings 22*a* and 22*b*. The end of the string 22*d* is fixed at point B on the frame 12. The distance between the parallel strings 22*a* and 22*b* on the one hand and 22*c* and 22*d* on the other is generally equal to the radius of a tennis ball.

The other lengths of string of the string array or network are strung in generally the same way as the length of string 22. The parallel strings of the separate lengths of string are generally equally spaced and take up the strings of other lengths of string between them. To take an example it will be seen that the string 24*d* of the length of string 24 is placed running between the strings 22*c* and 22*d* of the length of string 22, whereas the string 24*c* parallel thereto is placed outside the strings 22*c* and 22*d*, the length 24 being trained round points 40 on the frame 12.

Figure 2:
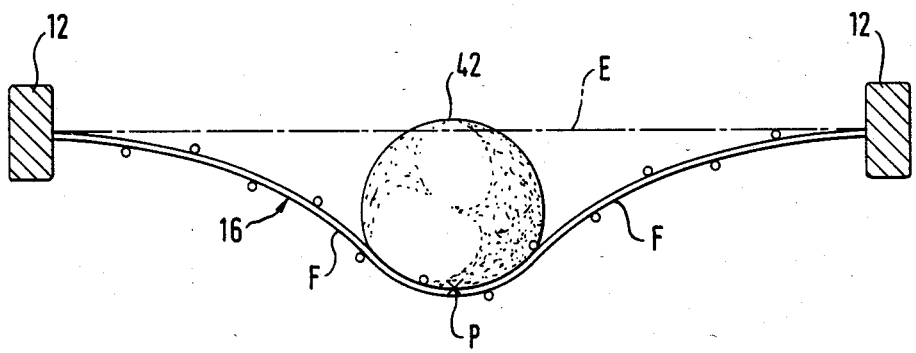
FIG. 2 is a diagrammatic view to make clear the bending or deflection of the strings of a tennis racket of the invention.

On the ball landing at a point P for example the strings 22*a*, 22*c* and 24*d* will be directly hit by the ball and stretched because of this. The pull force then produced in these strings is then transmitted more or less completely therein by the bend pulleys to the strings 22*b*, 22*d* and 24*c* so that in a ring-like part round the point P there will be an increased tension. The bending of the strings in the array 16 caused thereby is marked diagrammatically in FIG. 2. While in the zone of ball contact as such the strings are curved so as to become concave or dished in the normal way in relation to the ball, in the parts F next to this of the strings there will be a convex curving effect. For this reason the ball 42 is taken up in a relatively narrow trough giving better ball control and making certain that the ball 42 is speeded up in a direction generally normal to the plane E of the frame area on the strings whipping back into their normal or starting positions.

For cutting down the amount of friction at the cross-overs between the strings, the parallel families of strings, as for example the strings 22*a* and 22*b* on the one hand in FIG. 1 and the strings 22*c*, 22*d*, 24*c* and 24*d* are placed in two different planes. It will be seen from this that the strings are not woven inbetween each other but placed freely running past each other. To make certain on the other hand that there is no undesired distortion of the string array on hitting a ball, the strings are joined together at the cross-overs by links. Such a link is to be seen in FIG. 13 and is numbered 110. It is formed by two rings 112 and 114 that are joined together so that their middle axes are normal to each other and each have a string (70 in the one case and 70' in the other) running through them.

In keeping with another possible form of the racket of the invention the strings are woven in and out at the cross-overs in the normal way. In this case the strings are best made with a flattened cross section (having its thickness direction normal to the plane of the frame) so that at the cross-overs they are only pressed together with relatively small forces.

Such strings with a flattened cross section are best made with two cores of high tensile material with a square or round cross section placed within a common casing of low friction material. The casing then has a rectangular or elliptical cross section or is made up of two cross section parts, each having a core and which are joined together by a bridge.

The use of two cores of high tensile or tough material gives the string a resistance to twisting of the same order as that of a known string with a round cross section.

In keeping with a somewhat changed form of the invention each string has only one core. A decrease of the cross-over friction may then be made possible if the diameter of the strings is generally decreased. In this case the strings are best made of a material with a specially high tensile strength with a casing decreasing the friction effect if desired.

As we have see earlier in connection with FIG. 1, in the racket of the present invention the lengths of string, as for example the length 22, have tails running out past the edge of the frame as far as the handle 10 into which they are trained. Between the points C and D in FIG. 1 the length of string 22 is trained along without, generally speaking, touching any other parts so that the overall "live" length A-B may take part in the elastic stretching of the length of string 22 when the racket is hit by a ball.

The degree to which the separate lengths of string are made longer in this way as tails may be freely selected inasfar as the rider 18 is long and narrow and as may be seen from FIG. 1 has a large number of fixing means placed on top of each other, for example in the form of the holes 26. If length of string is fixed in the lower part of the rider 18 the tail of the string is increased in length representatively. Because in this way each string is given a stretching length of the right size and, on stringing, the string in question is acted upon by the right degree of tension force, it will be possible, after the stringing operation has been completed, for the strings generally to be tensioned at one and the same time and in step with each other using the tightening screw 20. In this respect the effect may again be profited from that the tension of the string length fixed in the top part of the rider 18, whose overall length is smaller, is more strongly increased or decreased. Because of the friction at the cross-overs of the strings, more specially when none of the measures noted earlier has been taken, there will be a decrease in the pretensioning force, produced by the tightening means in the handle 10 of the racket towards the end crown of the frame 12 opposite to the handle 10. Such a tension gradient or drop may certainly be put to good use when, to take an example, larger or smaller losses in impact and/or smaller increases in force in the edge part of the string array are desired.

FIG. 3 is a view on a larger scale of the rider 18 to be seen in FIG. 1. The rider 18 has a number of cross holes 26 placed one over the other in the length direction so as to make it possible for the strings to be threaded through at different levels. In FIG. 4, that is a further side view of the rider 18, in the lower part there are in each case two holes placed side by side so that two different string lengths may be threaded in at the same level. Furthermore in the lower part of FIGS. 3 and 4 the reader will see a threaded hole 44 to take up the tightening screw 20.

FIG. 5 is a view of another form of the rider that is here marked 18'. In place of the holes 26 as in FIGS. 3 and 4 in this case there are undercut openings 26' on the two opposite sides so that the separate strings may be placed in position at any desired level. There is again a threaded hole 44 to take up a tightening bolt, not figured.

The rider or slide may as such be made of an elastic material as for example rubber or elastic synthetic resin so that it will have a small damping or spring effect and is able to take up losses in impact. Because a deformation in the length direction of the rider undergoes addition in an upward direction (in the sense of FIGS. 3 to 5) this effect will be more specially marked in the top part of the riders figured. This event or property may be put to good use.

FIG. 6 is a diagrammatic cross section through the frame 12. Said frame is made up of a section whose two legs 46 and 48 are joined together by a web 58. At the same level as the plane of the section of FIG. 6 the web is cut back to have an opening to take up a pulley 50. In the present example this pulley is ball-like or spherical and has a groove 52 running round it for a string (not figured). The pulley 50 may be turned on a pin 54 that is taken up in opposite holes (not numbered) in the box section legs 46 and 48. For threading the pin into position there is a hole 56 in the top box section leg 46 in FIG. 6. FIG. 7 is a side view of the frame 12 to make clear the web 58 and the round openings 51 for the pulleys 50.

Figure 8:
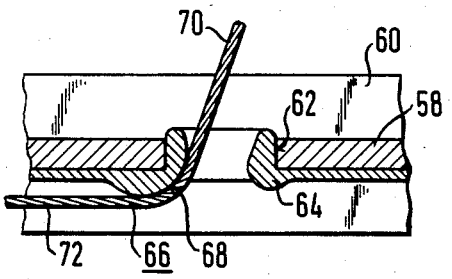

FIG. 8 is a part section through the web 58, that was not made part of FIG. 6, and a view of one of the box legs that is numbered 60 in FIG. 8. In a hole 62 in the web 58 there is a liner 64 or grommet of low-friction material, that at the point where a string 66 is bent and changed in direction has a bead-like rounded part 68 to make it possible for the string 66 to be moved along with generally no friction. Using such a design gives a connection, having low-friction properties as well, between the string part 70 within the frame and the string part or tail 72 placed outside the frame.

Figure 9:
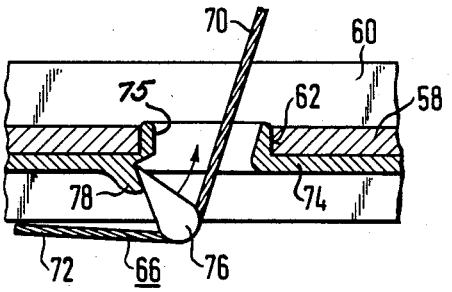

FIG. 9 is a view of a system of the same sort for training a string 66 and supporting it where it is bent. A liner numbered 74 is again taken up in the hole 62, but in place of having the rounded part 68 it has a sprag 76 that may be turned round in the direction of the arrow and is rounded off at its end. When the sprag 76 is acted upon by a pulling force towards the inside of the frame, that is to say upwards in FIG. 9, it is turned round and so puts up hardly any resistance to the motion of the string 66, whereas in the resting position to be seen in FIG. 9 it is kept in place by a stop 78 so that the string may only be pulled back on overcoming a certain force. This makes certain that the string 66, on being impacted by a ball hitting the string array, will give way somewhat but not with the same speed and free motion so that the ball will only be bounced back with a certain loss of impact.

Figure 10:
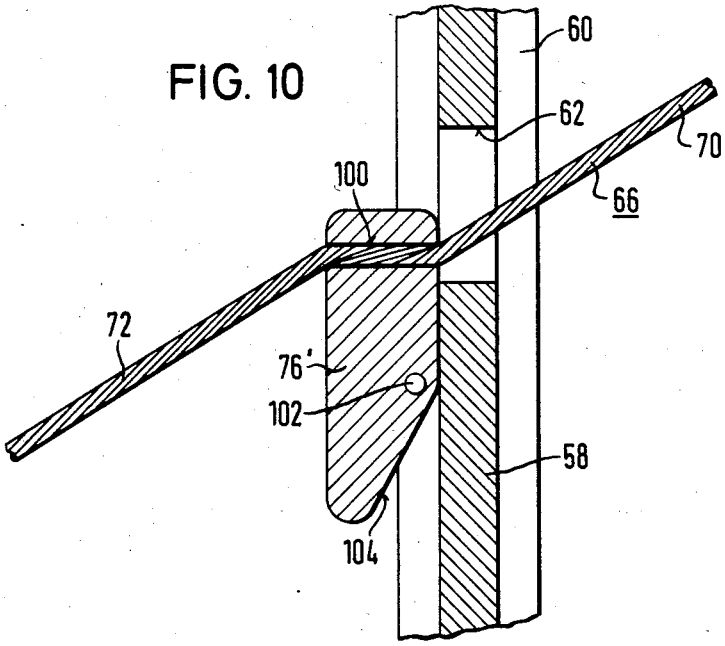
Figure 11:
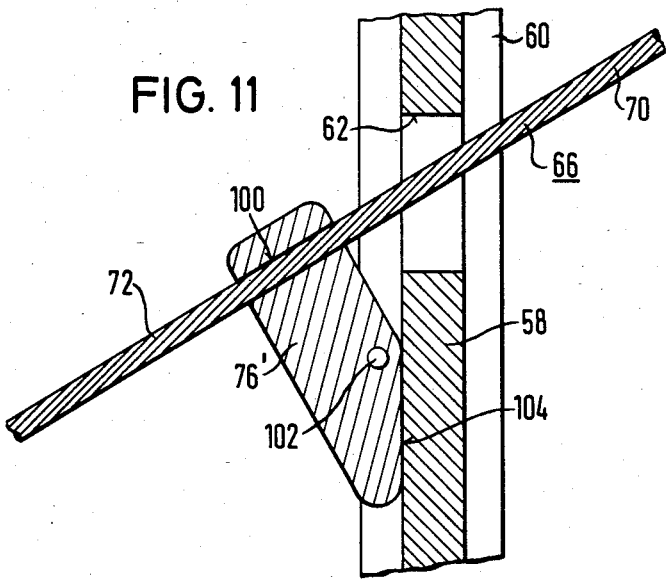

In FIGS. 10 and 11 the reader will see a further form of the way in which the strings may be bent at the frame. Here it is taken to be the case that the bending of the string is near the lower end of the frame 12 so that the string will be freely stretched from the frame to the rider 18. In this form of the invention the string 66 is run through a hole 100 in the sprag 76', that may be rocked about a pin 102 in a range as limited by the web 58 and a sloping face 104 of the sprag. By having the hole 100 at a slope in relation to the length direction of the string 66 the friction is greatly increased when the sprag 76 is rocked by a pulling force on the string part 70 into the position to be seen in FIG. 10.

If a string is to be made even longer than the tail or lengthened part so far noted, it is possible, as may be seen from FIGS. 12 etc., for a string 80 to be threaded backwards and forwards a number of times in the hollow handle between pulleys 82 and 84 at the lower end plate 14 and near the frame 12.

In the account hereinbefore the details of the invention have been given in connection with a tennis racket. However the racket is not limited to this and may be used with other rackets, more specially rackets for playing squash.

I claim:

1. A tennis racket for use in hitting tennis balls comprising:

a frame having a head and handle portion, a plurality of low friction points at spaced apart locations about said head portion, a plurality of string elements, each of said string elements having a plurality of substantially parallel passes extending in only one direction across the area defined within the head portion and over a predetermined series of individual ones of said plurality of low friction points so that the parallel passes are movable relative to said frame at said low friction points, said frame being strung with directly adjacent substantially parallel passes comprising portions of different string elements and so that the substantially parallel passes of the same string element are spaced apart a distance generally not less than about the radius of said tennis ball, and tension adjusting means provided on said racket for simultaneously tensioning said plurality of string segments.

2. The racket as in claim 1 wherein the low friction point is comprised of a pulley.

3. The racket as in claim 2 wherein each said pulley has a spherical form.

4. The racket as in claim 1 wherein crossing strings are placed in different planes running freely past each other, said crossing strings being joined together at their cross-overs by sliding connection links.

5. The racket as in claim 1 wherein each of said plurality of strings segments have a flattened cross-section, the size thereof in the plane of the frame being greater than in a direction normal to plane, said strings having a core of high-tensile material and an outer casing of low-friction material.

6. The racket as in claim 1 wherein said low friction points include means defining one-way friction brakes for allowing slipping of said strings towards the inside of the frame and braking slippage in the opposite direction.

7. The racket as in claim 1 wherein said racket includes a hollow handle and said tension adjusting means include a rider vertically movable within said hollow handle, said member receiving said string segments for adjustably determining the length of each of said string segments.

8. The racket as in claim 7 wherein said rider is comprised of an elastic material.

9. The racket as in claim 7 wherein said rider is elastically maintained in its position within said hollow handle.

10. A tennis racket for use in hitting a tennis ball comprising:

a frame having a head and a handle portion, a plurality of low friction elements at spaced apart locations about said frame head portion, and first and second sets of plural operative string elements each having a plurality of substantially parallel lengths extending across the frame in only one direction and being spaced apart within said frame head portion, lengths of different ones of said string elements within the same one of said first and second string sets being interleaved interwoven said first and second string sets crossing within said frame, said lengths of said string elements being spaced apart within said frame a sufficient distance such that a struck tennis ball cannot substantially strike more than one length of the same string element, each of said string elements passing over a predetermined series of individual ones of said plurality of low friction elements so that said plurality of string elements are movable relative to said frame at said low friction elements, whereby all strings striking a tennis ball impinging upon the frame head portion can elongate both directions from the area of engagement with the struck tennis ball to provide elasticity, and tension adjusting means connected to said first and second sets of string elements for simultaneously tensioning said string elements.

11. A combination as set forth in claim 10, wherein the handle is hollow, and wherein said tension adjusting means comprises means for axially translating within said hollow racket handle for coincidentally varying the tension in each of said string elements in each of said first and second string element sets.

* * * * *